US006193461B1

(12) United States Patent
Hablanian

(10) Patent No.: US 6,193,461 B1
(45) Date of Patent: Feb. 27, 2001

(54) DUAL INLET VACUUM PUMPS

(75) Inventor: Marsbed Hablanian, Wellesley, MA (US)

(73) Assignee: Varian Inc., Palo Alto, CA (US)

( * ) Notice: Subject to any disclaimer, the term of this patent is extended or adjusted under 35 U.S.C. 154(b) by 0 days.

(21) Appl. No.: 09/241,899

(22) Filed: Feb. 2, 1999

(51) Int. Cl.[7] ..... F01D 1/36

(52) U.S. Cl. ..... 415/90; 415/199.5; 415/143; 417/250

(58) Field of Search ..... 415/90, 116, 199.1, 415/199.2, 199.5, 114, 143; 417/250, 208, 170, 163

(56) References Cited

U.S. PATENT DOCUMENTS

| | | | | |
|---|---|---|---|---|
| 5,238,362 | | 8/1993 | Casaro et al. . | |
| 5,611,660 | * | 3/1997 | Wong et al. | 415/90 |
| 5,733,104 | | 3/1998 | Conrad et al. | 417/44.1 |
| 6,030,189 | * | 2/2000 | Bohm et al. | 415/90 |

FOREIGN PATENT DOCUMENTS

| | | |
|---|---|---|
| 3919529 | 1/1990 | (DE) . |
| 295 16 599 U | 12/1995 | (DE) . |
| 0 072 892 | 3/1983 | (EP) . |
| 0 280 984 | 9/1988 | (EP) . |
| 0 408 792 | 1/1991 | (EP) . |
| 0 731 278 | 9/1996 | (EP) . |
| 0 791 752 | 8/1997 | (EP) . |

* cited by examiner

*Primary Examiner*—Edward K. Look
*Assistant Examiner*—Hermes Rodriguez
(74) *Attorney, Agent, or Firm*—Bella Fishman

(57) ABSTRACT

A high-vacuum pump includes a first vacuum pump section and a second vacuum pump section coupled in series and having an interstage region between them. The vacuum pump further includes a housing containing the first and second vacuum pump sections. The housing includes a high conductance peripheral duct surrounding all or part of the interstage region and coupled to the interstage region. The housing defines a first inlet port coupled to an inlet of the first vacuum pump section, a second inlet port coupled to the peripheral duct, and an exhaust port coupled to an outlet of the second vacuum pump section. Examples of high-vacuum pumps according to the invention include turbomolecular vacuum pumps, diffusion pumps and mixed vacuum pumps which include both axial flow stages and molecular drag stages.

17 Claims, 3 Drawing Sheets

DUAL INLET VACUUM PUMPS

FIELD OF THE INVENTION

This invention relates to high-vacuum pumps used for evacuating vacuum enclosures and, more particularly, to dual inlet high-vacuum pumps which may be used for evacuating different chambers of a vacuum enclosure. The invention may be implemented in turbomolecular vacuum pumps and diffusion pumps, but is not limited to these types of vacuum pumps.

BACKGROUND OF THE INVENTION

Conventional turbomolecular vacuum pumps include a housing having an inlet port, an interior chamber containing a plurality of axial flow pumping stages and an exhaust port. The exhaust port is typically attached to a roughing vacuum pump. Each axial flow pumping stage includes a stator having inclined blades and a rotor having inclined blades. The rotor and stator blades are inclined in opposite directions. The rotor blades are rotated at high speed to provide pumping of gases between the inlet port and the exhaust port. A typical turbomolecular vacuum pump may include nine to twelve axial flow pumping stages.

Variations of the conventional turbomolecular vacuum pump are known in the prior art. In one prior art configuration, one or more of the axial flow pumping stages are replaced with disks which rotate at high speed and which function as molecular drag stages. This configuration is disclosed in U.S. Pat. No. 5,238,362 issued Aug. 24, 1993 to Casaro et al. A turbomolecular vacuum pump including an axial turbomolecular compressor and a molecular drag compressor in a common housing is sold by Varian Associates, Inc. under Model No. 969-9007. Turbomolecular vacuum pumps utilizing molecular drag disks and regenerative impellers are disclosed in German Patent No. 3,919,529 published Jan. 18, 1990.

Molecular drag compressors include a rotating disk and a stator. The stator defines a tangential flow channel, and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel, thereby directing the molecules toward the outlet and pumping the gas.

Some instruments and processing systems have two or more vacuum chambers which it is desirable to operate at different pressure levels. The chambers may be connected through one or more orifices that are small enough to permit establishment of different pressure levels. Examples include mass spectrometers, molecular beam systems and ion beam systems. One approach is to connect a separate vacuum pump to each of the vacuum chambers. Another approach, which is typically more economical, is to utilize a single vacuum pump having two or more inlets which are connected to different points in a single vacuum pump. The inlets are connected to different vacuum chambers.

An example of a prior art dual inlet turbomolecular vacuum pump 10 is shown in FIG. 4. The turbomolecular vacuum pump (turbopump) 10 includes a first pumping section 12, a second pumping section 14 and an interstage region 16 between pumping sections 12 and 14. First pumping section 12 includes axial flow pumping stages 20, 22, etc., and second pumping section 14 includes axial flow pumping stages 30, 32, etc. A housing 40 has a first inlet port 42 coupled to an inlet of first vacuum pumping section 12, a second inlet port 44 coupled through a conduit 46 to interstage region 16, and an exhaust port 48 coupled to an outlet 50 of second vacuum pumping section 14. Each of the axial pumping stages 20, 22, 30, 32, etc. includes a stator having inclined blades and a rotor having inclined blades. The rotor of each axial pumping stage is connected by a shaft 52 to a motor 54.

In use, first inlet port 42 is connected to a first vacuum chamber (not shown) at a relatively low pressure and second inlet port is connected to a second vacuum chamber (not shown) at a higher pressure level. The first and second chambers are evacuated simultaneously by turbopump 10.

The turbopump configuration shown in FIG. 4 provides generally satisfactory performance, but has certain disadvantages. The interstage region 16 has a relatively large axial dimension parallel to shaft 52 in order to provide adequate gas conductance between second inlet port 44 and second pumping section 14. This requires a lengthening of shaft 52 in order to provide the same performance as an equivalent single inlet turbopump. This results in increased size and cost of the turbopump. In addition, since the shaft and rotors are typically cantilevered from the motor end of the turbopump, the increased shaft length may give rise to problems in balancing the turbopump for high speed operation and in reduction of bearing life.

Accordingly, it is desirable to provide vacuum pump configurations which overcome one or more of the above disadvantages.

SUMMARY OF THE INVENTION

According to a first aspect of the invention, a vacuum pump is provided. The vacuum pump comprises a first vacuum pump section and a second vacuum pump section coupled in series and having an interstage region between them. The vacuum pump further comprises a housing containing the first and second vacuum pump sections. The housing includes a high conductance peripheral duct surrounding all or part of the interstage region and coupled to the interstage region. The housing defines a first inlet port coupled to an inlet of the first vacuum pump section, a second inlet port coupled to the peripheral duct and an exhaust port coupled to an outlet of the second vacuum pump section.

In a first embodiment, the vacuum pump comprises a turbomolecular vacuum pump. In a second embodiment, the vacuum pump comprises a diffusion pump. In a third embodiment, the vacuum pump comprises a mixed vacuum pump including both axial flow stages and molecular drag stages.

According to a second aspect of the invention, a vacuum pump comprises two or more axial flow stages coupled in series, a motor, a shaft and a housing containing the axial flow stages. The axial flow stages are divided into a first pump section and a second pump section separated from the first pump section by an interstage region. Each of the axial flow stages comprises a rotor and stator. The shaft is coupled between the motor and the rotor of each of the axial flow stages. The housing includes a high conductance peripheral duct surrounding all or part of the interstage region and coupled to the interstage region. The housing defines a first inlet port coupled to an inlet of the first pump section, a second inlet port coupled to the peripheral duct, and an exhaust port coupled to an outlet of the second pump section. The second pump section may optionally include one or more molecular drag stages.

According to a third aspect of the invention, a diffusion pump comprises two or more vapor jet stages coupled in series, a vapor source for supplying a vapor to the vapor jet stages and a housing containing the vapor jet stages. The vapor jet stages are divided into a first pump section and a second pump section having an interstage region between them. The housing includes a high conductance peripheral duct surrounding all or part of the interstage region and coupled to the interstage region. The housing defines a first inlet port coupled to an inlet of the first pump section, a second inlet port coupled to the peripheral duct, and an exhaust port coupled to an outlet of the second pump section.

In each embodiment, the housing may comprise a generally cylindrical wall having an annular gap adjacent to the interstage region. The peripheral duct may surround the annular gap and may be coupled through the annular gap to the interstage region.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
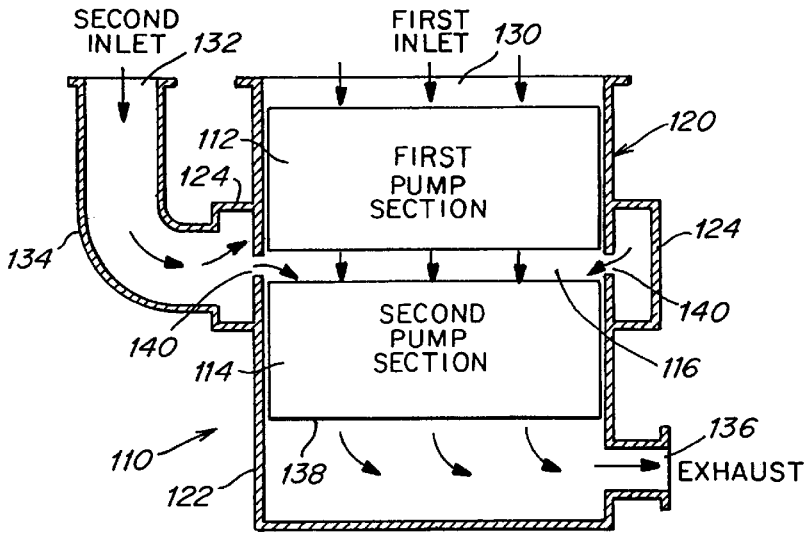
FIG. 1 is a cross-sectional schematic diagram of a dual inlet vacuum pump in accordance with the invention.

A cross-sectional schematic diagram of an embodiment of a dual inlet vacuum pump in accordance with the present invention is shown in FIG. 1. A vacuum pump 110 includes a first pump section 112, a second pump section 114 and an interstage region 116 between first pump section 112 and second pump section 114. Each of the first and second pump sections 112 and 114 may include one or more vacuum pumping stages, as described below. A housing 120 includes a wall 122 and a peripheral duct 124 which surrounds all or part of interstage region 116 and is in fluid communication with interstage region 116. Housing 120 is provided with a first inlet port 130 coupled to an inlet of first pump section 112, a second inlet port 132 coupled through a conduit 134 to peripheral duct 124, and an exhaust port 136 coupled to an outlet 138 of second pump section 114. Pump sections 112 and 114 are coupled in series between inlet port 130 and exhaust port 136, and an outlet of first pump section 112 is coupled through interstage region 116 to an inlet of second pump section 114. Vacuum pump 110 may be configured to have more than two inlet ports within the scope of the invention.

Peripheral duct 124 surrounds all or a selected portion of wall 122 of housing 120 and has a cross-section that provides a relatively high gas conductance. Wall 122, which may be generally cylindrical in shape, is provided with a gap 140 adjacent to interstage region 116. Where wall 122 is cylindrical, gap 140 may be annular. Gap 140 provides a relatively high conductance passage between peripheral duct 124 and interstage region 116. The cross-sectional area and length of conduit 134, the cross-sectional area and length of peripheral duct 124 and the dimensions of gap 140 are selected to provide a desired gas conductance between second inlet port 132 and interstage region 116. As indicated, peripheral duct 124 may surround all or a selected portion of wall 122. When peripheral duct 124 extends around less than the full circumference of wall 122, gap 140 is dimensioned to be enclosed by peripheral duct 124. The relatively large axial dimension of interstage region 16 in prior art turbopump 10 is replaced in the vacuum pump of FIG. 1 with interstage region 116 having a relatively small axial dimension. Adequate gas conductance from conduit 132 to second pump section 114 is achieved by peripheral duct 124 and gap 140.

In operation, gas is pumped from first inlet port 130 through first pump section 112 and second pump section 114 to exhaust port 136. In addition, gas is pumped from second inlet port through second pump section 114 to exhaust port 136. As a result, inlet port 130 has a relatively low pressure, second inlet port 132 and interstage region 116 have an intermediate pressure and exhaust port 136 has a relatively high pressure. Thus, inlet ports 130 and 132 may be connected to different vacuum chambers at different pressure levels.

Figure 2:
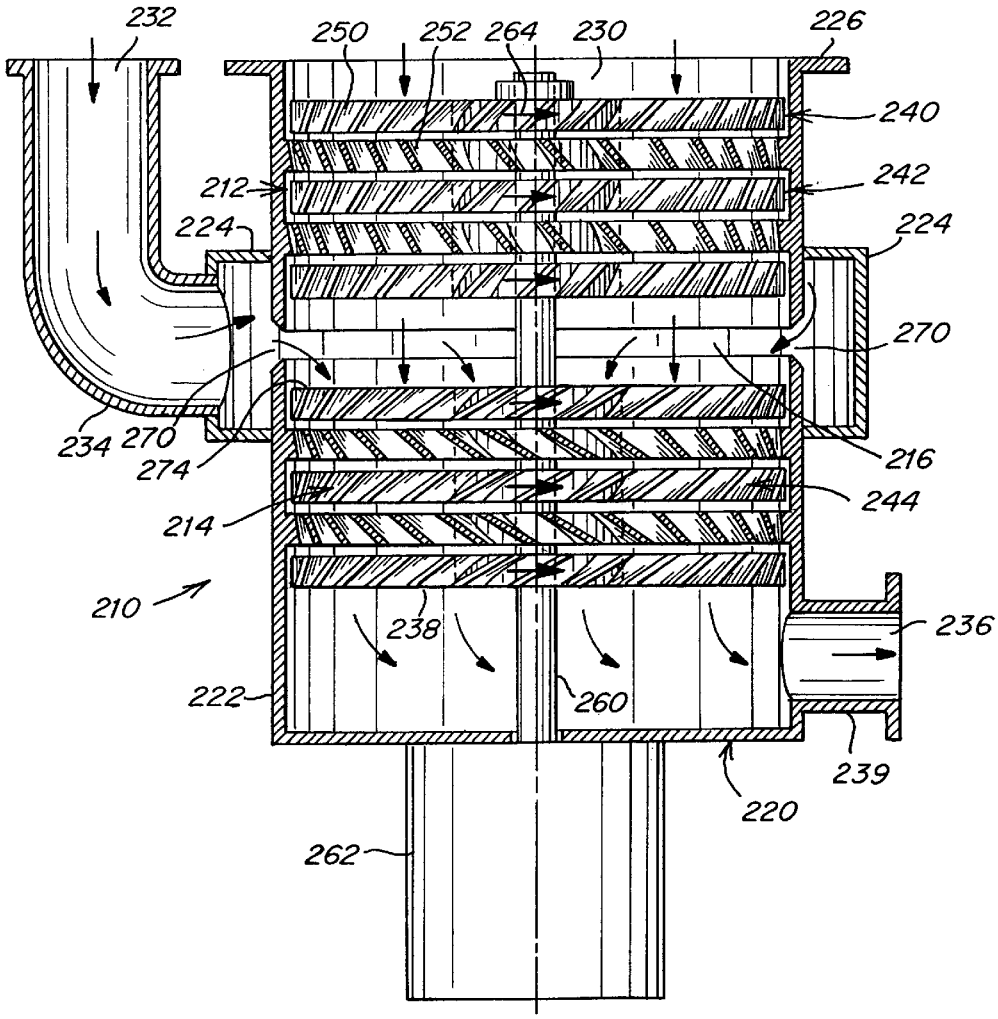
FIG. 2 is a simplified cross-sectional view of a dual inlet turbomolecular vacuum pump in accordance with a first embodiment of the invention.

A first embodiment of the invention is shown in FIG. 2. A dual inlet turbomolecular vacuum pump 210 includes a first pump section 212, a second pump section 214 and an interstage region 216 between pump sections 212 and 214. A housing 220 defines an interior chamber containing first pump section 212, second pump section 214 and interstage region 216. Housing 220 may include a generally cylindrical wall 222 and a vacuum flange 226 for sealing the turbopump 210 to a vacuum chamber (not shown) to be evacuated. A peripheral duct 224 surrounds all or a part of interstage region 216. Housing 220 further includes a first inlet port 230 coupled to an inlet of first pump section 212, a second inlet port 232 coupled through a conduit 234 to peripheral duct 224 and an exhaust port 236 coupled to an outlet 238 of second pump section 214 through a conduit 239. The exhaust port 236 is typically connected to a backing vacuum pump (not shown). In cases where the turbopump is capable of exhausting to atmospheric pressure, a backing pump is not required. Turbopump 210 may have more than two inlet ports within the scope of the invention.

First pump section 212 and second pump section 214 may each include one or more axial flow vacuum pumping stages such as stages 240, 242 and 244. Each of the axial flow stages includes a rotor 250 and a stator 252. Typically turbomolecular vacuum pumps have about nine to twelve stages.

Each rotor 250 includes a central hub attached to a shaft 260, and inclined blades around its periphery. The shaft 260 is rotated at high speed by a motor 262 in a direction indicated by arrows 264 in FIG. 2. The gas molecules are directed generally axially by each axial pumping stage from inlet ports 232 and 232 to exhaust port 236. Each stator includes a central hub with an opening for shaft 260. The stator hubs do not contact shaft 260. The stators also have inclined blades. The blades of the rotor and the blades of the stator are inclined in opposite directions. The structure of axial flow stages is generally known to those skilled in the art.

Interstage region 216 may have a relatively short axial dimension and may be formed by omitting one or more of the stators in a conventional turbopump. The interstage region 216 may have, for example, an axial dimension in a range of about 0.75 to 1.5 inches (depending on the pump size). An annular gap 270 is provided in cylindrical wall 222 of housing 220. Annular gap 270 is aligned with and provides access to interstage region 216 from the exterior of cylindrical wall 222. Peripheral duct 224 surrounds all or part of interstage region 216 and is aligned with annular gap 270. Annular gap 270 may have, for example, an axial dimension in a range of about 0.25 to 0.75 inches (depending on the pump size).

Figure 4:
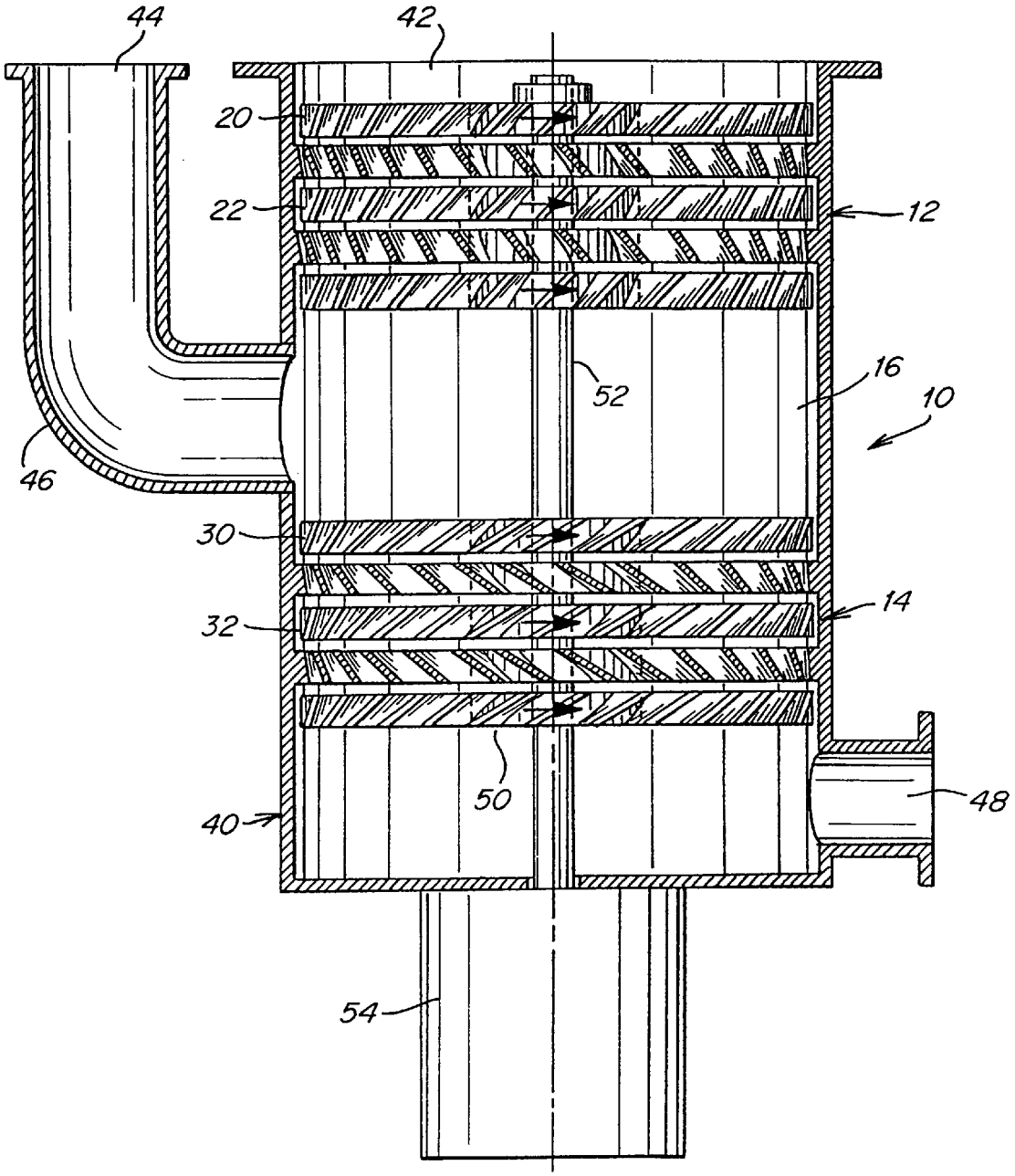
Fig. 4 PRIOR ART
FIG. 4 is a cross-sectional view of a prior art dual inlet turbomolecular vacuum pump.

The combination of peripheral duct 224 and annular gap 270 provides a high gas conductance path between conduit 234 and interstage region 216. Thus, gas pumped through second inlet port 232 passes through conduit 234 and into peripheral duct 224. The gas flows around peripheral duct 224 and passes from peripheral duct 224 through annular gap 270 into interstage region 216. Thus, even though annular gap 270 has a small axial dimension, high conductance is achieved by the circumferential extent of peripheral duct 224 and annular gap 270. As indicated above peripheral duct 224 and annular gap 270 may extend around the entire circumference of cylindrical wall 222 or around a selected part of cylindrical wall 222 to achieved a desired gas conductance between inlet port 232 and interstage region 216. Gas flows into interstage region 216 around all or part of its periphery rather than through a single opening, as in the prior art turbopump of FIG. 4. It will be understood that interstage region 216 receives gas through annular gap 270 and from the outlet of first pump section 212. The gas is then pumped by second pump section 214 to exhaust port 236. In a preferred embodiment, a rotor 274 of the first axial flow pumping stage of second pump section 214 has relatively high blade angles to achieve high pumping speed.

One or more of the axial flow pumping stages in turbopump 210 may be replaced with a molecular drag stage. Typically, axial flow stages near exhaust port 236 are replaced with molecular drag stages. However, in general, one or more axial flow stages in either or both of pump sections 212 and 214 may be replaced with molecular drag stages within the scope of the present invention.

Peripheral duct 224 may be sealed to cylindrical wall 222 or may be an integral part of cylindrical wall 222. Likewise, peripheral duct 224 may be sealed to or may be an integral part of conduit 234. The housing 220, including cylindrical wall 222, peripheral duct 224, flange 226, conduit 234 and conduit 239, may be fabricated as one or more pieces within the scope of the invention. Where peripheral duct 224 surrounds cylindrical wall 222, duct 224 has a generally toroidal shape. The interior cross-sectional area of peripheral duct 224 is selected to provide a desired gas conductance between conduit 234 and interstage region 216. In general, peripheral duct 224 should have as large a cross-sectional area as is practical, within the size and cost constraints of the application.

Figure 3:
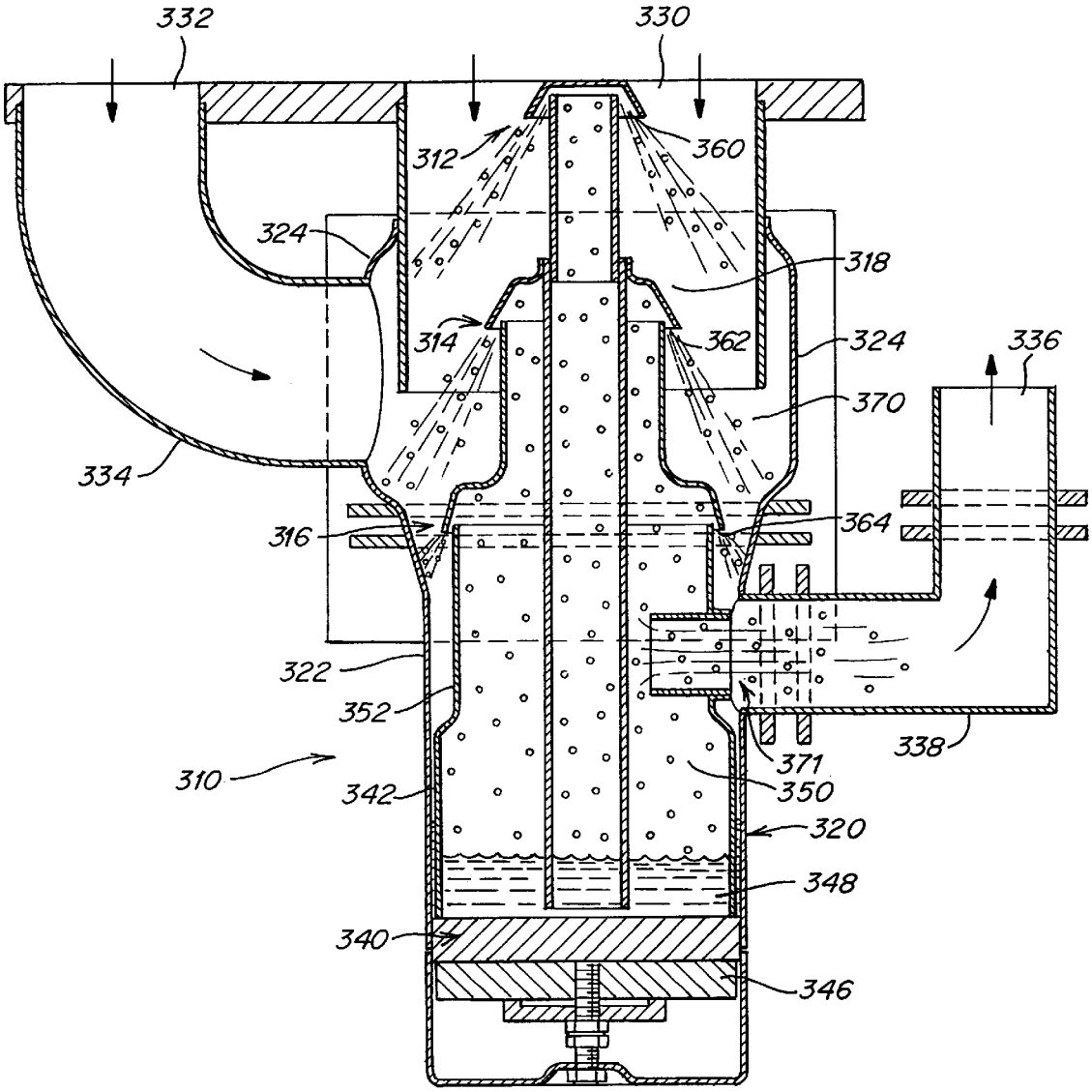
FIG. 3 is a simplified cross-sectional view of a dual inlet diffusion pump in accordance with a second embodiment of the invention.

A second embodiment of the invention is shown in FIG. 3. A dual inlet diffusion vacuum pump 310 includes a first vapor jet stage 312, a second vapor jet stage 314, a third vapor jet stage 316, and a fourth vapor jet stage 371. An interstage region 318 is located between first stage 312 and second stage 314. In the embodiment of FIG. 3, vapor jet stage 312 constitutes a first pump section, and vapor jet stages 314, 316 and 371 constitute a second pump section. The diffusion pump 310 includes a housing 320 having a generally cylindrical wall 322. A peripheral duct 324 surrounds interstage region 318. A first inlet port 330 is coupled to an inlet of first vapor jet stage 312; a second inlet port 332 is coupled through a conduit 334 to peripheral duct 324, and an exhaust port 336 is coupled to outlets of third vapor jet stage 316 and fourth vapor jet stage 371 through a conduit 338. The diffusion pump 310 may include more than two inlet ports within the scope of the invention.

A boiler 340 located at the bottom portion of housing 320 is the vapor source for vapor jet stages 312, 314, 316, and 371. Boiler 340 includes a boiler shell 342, a heater 346 and a liquid reservoir 348. The heater 346 causes a liquid in reservoir 348 to boil off as a vapor which passes through an interior region 350 of a jet assembly 352.

Jet assembly 352 has an annular opening 360 through which the vapor passes in a conical spray to form first vapor jet stage 312, a second annular opening 362 through which vapor passes in a conical spray to form second vapor jet stage 314 and a third annular opening 364 through which vapor passes in a conical spray to form third vapor jet stage 316. The configuration of jet assembly 352 to form vapor jet stages 312, 314, 316, and 371 is conventional in diffusion pumps. Each vapor jet stage includes a nozzle which directs vapor from the vapor source in the direction of exhaust port 336. The vapor is condensed by the cooled cylindrical wall 322 of housing 320, and the condensed vapor returns to reservoir 348 for recycling.

Peripheral duct 324 surrounds the cylindrical wall 322 of housing 320 or a selected portion thereof and provides a high conductance path between conduit 334 and interstage region 318 through an annular gap 370 in cylindrical wall 322. Peripheral duct 324 provides a high conductance path from second inlet port 322 to interstage region 318, without requiring a substantial increase in the length of the diffusion pump 310. Housing 320, including wall 322, peripheral duct 324, conduits 334 and 338, may be fabricated as one or more pieces within the scope of the invention.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A high-vacuum pump comprising:

a first vacuum pump section and a second vacuum pump section coupled in series and having an interstage region between them;

a housing containing said first and second vacuum pump sections; and a high conductance peripheral duct protruded outwardly from said housing and coupled to said interstage region, said peripheral duct surrounding all or part of said interstage region; said housing defining a first inlet port coupled to an inlet of said first vacuum pump section, a second inlet port coupled to said peripheral duct and an exhaust port coupled to an outlet said second vacuum pump section.

2. The high-vacuum pump as defined in claim 1 wherein said first and second vacuum pump sections each comprise one or more axial flow pumping stages.

3. The high-vacuum pump as defined in claim 1 wherein said first vacuum pump section comprises one or more axial flow pumping stages and said second vacuum pump section comprises one or more molecular drag stages.

4. The high-vacuum pump as defined in claim 1 wherein said housing comprises a wall having a gap adjacent to said interstage region and wherein said peripheral duct surrounds said gap and is coupled through said gap to said interstage region.

5. The high-vacuum pump as defined in claim 1 comprising a turbomolecular vacuum pump wherein said first vacuum pump section comprises one or more axial flow pumping stages and wherein said second vacuum pump section comprises one or more axial flow pumping stages.

6. The high-vacuum pump as defined in claim 5 wherein said housing comprises a generally cylindrical wall having an annular gap adjacent to said interstage region and wherein said peripheral duct comprises an annular duct surrounding said annular gap and coupled through said annular gap to said interstage region.

7. The high-vacuum pump as defined in claim 5 wherein said interstage region has an axial dimension of one or more of said axial flow pumping stages.

8. The high-vacuum pump as defined in claim 5 wherein each of said axial flow pumping stages comprises a rotor and a stator, wherein the stators are mounted on a shaft coupled to a motor, said shaft having a length selected to provide said interstage region.

9. The high-vacuum pump as defined in claim 1 wherein said first vacuum pump section comprises at least one vapor jet vacuum pumping stage and wherein said second vacuum pump section comprises at least one vapor jet vacuum pumping stage.

10. The high-vacuum pump as defined in claim 9 wherein said housing comprises a generally cylindrical wall having an annular gap adjacent to said interstage region and wherein said peripheral duct comprises an annular duct surrounding said annular gap and coupled through said annular gap to said interstage region.

11. A high-vacuum pump comprising:

two or more axial flow stages coupled in series, said axial flow stages divided into a first pump section and a second pump section separated from said first pump section by an interstage region, each of said axial flow stages comprising a rotor and a stator;

a motor;

a shaft coupled between said motor and the rotor of each of said axial flow stages; and a housing containing said axial flow stages; and a high conductance peripheral duct protruded outwardly from said housing and coupled to said interstage region, said peripheral duct surrounding all or part of said interstage region; said housing defining a first inlet port coupled to an inlet of said first pump section, a second inlet port coupled to said peripheral duct and an exhaust port coupled to an outlet of said second pump section.

12. The high-vacuum pump as defined in claim 11 wherein said housing comprises a generally cylindrical wall having an annular gap adjacent to said interstage region and wherein said peripheral duct comprises an annular duct surrounding said annular gap and coupled through said annular gap to said interstage region.

13. The high-vacuum pump as defined in claim 11 wherein said second pump section further comprises one or more molecular drag stages.

14. The diffusion pump comprising:

two or more vapor jet stages coupled in series, said vapor jet stages divided into a first pump section and a second pump section having an interstage region between them;

a vapor source for supplying a vapor to said vapor jet stages; and a housing containing said vapor jet stages, said housing including a high conductance peripheral duct surrounding all or part of said interstage region and coupled to said interstage region, said housing defining a first inlet port coupled to an inlet of said first pump section, a second inlet port coupled to said peripheral duct and an exhaust port coupled to an outlet of said second pump section.

15. The diffusion pump as defined in claim 14 wherein said housing comprises a generally cylindrical wall having an annular gap adjacent to said interstage region and wherein said peripheral duct comprises an annular duct surrounding said annular gap and coupled through said annular gap to said interstage region.

16. A high-vacuum pump comprising:

one or more axial flow stages and one or more molecular drag stages coupled in series, said axial flow stages and said molecular drag stages divided into a first pump section and a second pump section separated from said first pump section by an interstage region, each of said axial flow stages and said molecular drag stages comprising a rotor and a stator;

a motor;

a shaft coupled between said motor and the rotor of each of said axial flow stages and said molecular drag stages;

a housing containing said axial flow stages and said molecular drag stages; and a high conductance peripheral duct protruded outwardly from said housing and coupled to said interstage region said peripheral duct surrounding all or prior art of said interstage region; said housing defining a first inlet port coupled to an inlet of said first pump section, a second inlet port coupled to said peripheral duct, and an exhaust port coupled to an outlet of said second pump section.

17. The high-vacuum pump as defined in claim 16 wherein said housing comprises a generally cylindrical wall having an annular gap adjacent to said interstage region and wherein said peripheral duct comprises an annular duct surrounding said annular gap and coupled through said annular gap to said interstage region.

* * * * *